US005685750A

United States Patent [19]

Rantilla

[11] Patent Number: 5,685,750

[45] Date of Patent: Nov. 11, 1997

[54] ROWING APPARATUS

[76] Inventor: Ronald R. Rantilla, 6 County Rd., Barrington, R.I. 02806

[21] Appl. No.: 498,588

[22] Filed: Jul. 6, 1995

[51] Int. Cl.[6] ..... B63H 16/06

[52] U.S. Cl. ..... 440/104

[58] Field of Search ..... 440/101, 102, 440/103, 104, 105, 106, 107; 416/74, 75

[56] References Cited

U.S. PATENT DOCUMENTS

| | | | |
|---|---|---|---|
| 88,013 | 3/1869 | Conner | 440/104 |
| 89,663 | 5/1869 | Heroux | 440/101 |
| 185,032 | 12/1876 | Isaacs | 440/105 |
| 282,121 | 7/1883 | Rutter | 440/105 |
| 387,743 | 8/1888 | Smith | 440/104 |
| 578,815 | 3/1897 | Fryer | 440/101 |
| 2,995,763 | 8/1961 | Rounds | 440/107 |

*Primary Examiner*—Stephen Avila

[57] ABSTRACT

Improvement to boat rowing in which the oars are upwardly biased, rotationally biased and forwardly biased to lift out of the water, rotate into the feathered position and swing to the front of the boat when at rest. A cord, attached to foot pedals, pulls the oars into the vertical position, down into the water and rearward in the water for the power stroke. Oars may be operated by hands only, by feet only or by hands and feet.

10 Claims, 2 Drawing Sheets

ROWING APPARATUS

SUMMARY OF THE INVENTION

My invention relates to improvements to boat rowing.

Traditional rowing is done facing the rear of the boat and using oarlocks mounted on the sides of the boat or on outriggers. The oars are grasped by the hands, and all power delivered to the oars passes through the hands. Sliding seats are used to bring leg power into play, but all of the power is transferred through the hands.

My invention has two independent power paths for each oar, one for the hands, another for the feet. It allows the use of arms only to propel the boat, legs only to propel the boat, or a combination of arms and legs to propel the boat. It has many applications for handicapped users because it can make use of any two limbs, for example one arm and one leg, even if they are on the same side of the body. In addition, my invention allows able bodied rowers to use their hands for other purposes, such as handling cameras or charts, while continuing to row with their feet and it reduces stress on the hands.

My invention uses end mounted (class 3 lever) forward facing oars. The oarlock are mounted on an uprigger near the center of the boat. The oarlocks include a means for upwardly biasing the oars to lift them out of the water when at rest. The oars are forwardly biased to swing forward to a point at the beginning of the power stroke when at rest. The oars are rotatable about 90 degrees for feathering and have stops to limit the rotation to the correct amount. The oars are biased to rotate forward (into the flat or feathered position) when at rest. This means that if there are no other forces acting on the oar, it will lift out of the water, rotate flat and swing forward, ready for the power stroke. A power delivery cord is attached to the oar. The attachment means is off-center and above the rotational axis, so that a rearward pull on the cord will tend to rotate the oar backward (into the vertical or power delivery position). The cord is guided by pulleys arranged so that as it pulls the oar rearward it also pulls the oar downward (into the water). The other end of the cord is attached to a foot pedal which is attached to a swing arm suspended from an axle above the operator's foot. This arrangement allows oar power to be delivered by movement of the foot pedal only, without the use of the hands. As the foot pushes the pedal forward, it pulls the cord which is guided by the pulleys to a point behind the oar and below the oar attachment point. The cord pull rotates the oar into the vertical position and pulls it down into the water. Continued cord pulling moves it toward the rear of the boat, propelling the boat forward. At the end of the power stroke, the foot is drawn back toward the operator and the cord goes slack. The oar upward biasing means at the oarlock lifts the oar up out of the water and the rotational biasing means rotates the oar flat and the forward biasing means swings the oar forward-awaiting the next power stroke. The oar has a handle located on the oar loom and can be powered by the hand in the ordinary way. Hand power may be used alone or to augment foot power.

DISCUSSION OF PRIOR ART

I am aware that in the past means have been devised to use end mounted oars in a forward facing position, to bias oars to lift them out of the water when at rest, to limit oar rotation for feathering and power positions and to attach sliding footrests to oars by means of ropes and pulleys. My invention does not claim these elements as new, but uses them in a combination which has never been used before and in combination with new elements to produce never before possible results such as rowing without the use of hands.

One of the elements of my invention which is new to the art is the forward biasing of the oar to swing it to the front ready for the power stroke. The combination of upwardly biased oars and power delivery linkage vectored downward is new and allows hands free lifting and dipping of the oars. The combination of forwardly, rotationally and upwardly biased oars connected to off-center and downwardly vectored power delivery linkage is new and allows hands free operation of the oars, automatically lifting, dipping, feathering, unfeathering and returning the oar in the proper sequence.

U.S. Pat. No. 387,743 to Smith discloses sliding footrest connected by cords passing around pulleys to oars fulcrumed on the sides of the boat. This system could not be used hands free because there is no means for lifting the oars out of the water nor for automatically feathering the oars, nor for returning the oars to the front.

U.S. Pat. No. 557,318 to Tenney discloses automatic feathering oars which uses the pressure of the water on an eccentric oar blade to rotate the blade into a horizontal position. This requires that the blade be in contact with the water to maintain the feathered position, causing more drag than feathered oars which are out of the water.

U.S. Pat. No. 4,383,830 to Cartwright discloses a traveling stretcher and traveling rigger with springs to pull the stretcher back toward the operator. The system uses traveling oarlocks rather than a traveling seat to bring leg power into play and the spring does not act directly on the oar. The use of hands is required to operate the oars for power delivery, lifting, dipping and feathering.

U.S. Pat. No. 356,846 to Martin discloses a harness for connecting the back and arms to the oars to assist with pulling on the oars. The use of hands is required to return the oar to the forward position, to lift the oar out of the water and to feather the oar. There is no means of using the legs to directly power the oars.

U.S. Pat. No. 287,088 to Beckers discloses torsion springs to lift the oars, but the use of hands would be required to deliver power to the oars, lower the oars, feather them and return them to the forward position.

U.S. Pat. No. 5,215,482 to Henry discloses a spring biased oar lifting means, but uses the hands to deliver power and control to the oars indirectly through elongate handles. There is no means of using the legs to directly power the oars. There is no means of forwardly biasing the oars. There is no means of rotationally biasing the oars into the feathered position.

U.S. Pat. No. 5,127,859 to Rantilia discloses a spring lifting means, but does not have a means of returning the oars to the front and requires the hands to deliver the power to the oars and to control feathering.

U.S. Pat. No. 2,995,763 to Rounds discloses a device for holding an oar in a selected position, substantially at a right angle to the lengthwise centerline of the boat, when it is desirable to remove the oars from the water without placing them in the boat. The device uses two springs stretched between the handle loom portion of the oar and the gunwale, one forward and one aft of the oarlock. The device is for use on an oar of the type having the oarlock mounted on the gunwale and could not be used to lift end mounted oars. Any springs disposed between an end mounted oar and the gunwale of a boat would pull the oar blade end downward instead of upward. Rounds teaches that when it is desirable to use the oar the springs are to be disengaged, although the boat can be propelled by using short strokes with the springs engaged. Rounds does mention that the angle of the oar with respect to the centerline of the boat can be changed, but no suggestion is made that the device be used to forwardly bias an oar under normal operation. No mention is made of rowing without using the hands. No mention is made of the device acting to feather the oars. No mention is made of using foot pedals or auxiliary handles to power an oar.

U.S. Pat. No. 282,121 to Rutter discloses a spring assisted oar lifting and turning device. The oar can be operated by grasping the oar or the auxiliary handle. He teaches that the oar is to be pushed forward. No mention is made of forwardly biasing the oar. No mention is made of using foot pedals. No mention is made of rowing without using the hands.

U.S. Pat. No. 185,032 to Isaacs discloses reciprocating rowlocks connected to a movable seat. Isaacs invention is concerned with moving the rowlocks rather than moving the oars. Isaacs mentions that moving rowlocks were known to be used in combination with movable stretchers, spiral springs and a stationary seat. Exactly how the spiral springs are used is not explained, but it is likely that they acted on either the stretcher or on the rowlocks, and not directly on the oars, as no mention of oars is made anywhere in the disclosure. No mention is made of rowing without using the hands. No mention is made of biasing oars to the front.

U.S. Pat. No. 578,815 to Fryer discloses a manually operated driving mechanism for screw powered boats. His invention uses levers attached to ropes to operate a drum, and uses a footlever to operate a steering rudder. His invention is not pertinent to rowing without using the hands.

U.S. Pat. No. 89,663 to Heroux discloses a foot operated crossbar connected to oars via chains and levers. He teaches that it will at all times be necessary to guide the oars with the hands. No mention is made of biasing oars to the front.

U.S. Pat. No. 88,013 to Conner discloses an end mounted oar with an auxiliary handle and a spring to aid in lifting and feathering the oar. Conner teaches that the handle is to be pushed and pulled by the oarsman. No mention is made of forwardly biasing the oar or of rowing without the use of the hands.

LIST OF REFERENCE NUMERALS IN DRAWINGS

Figure 1:
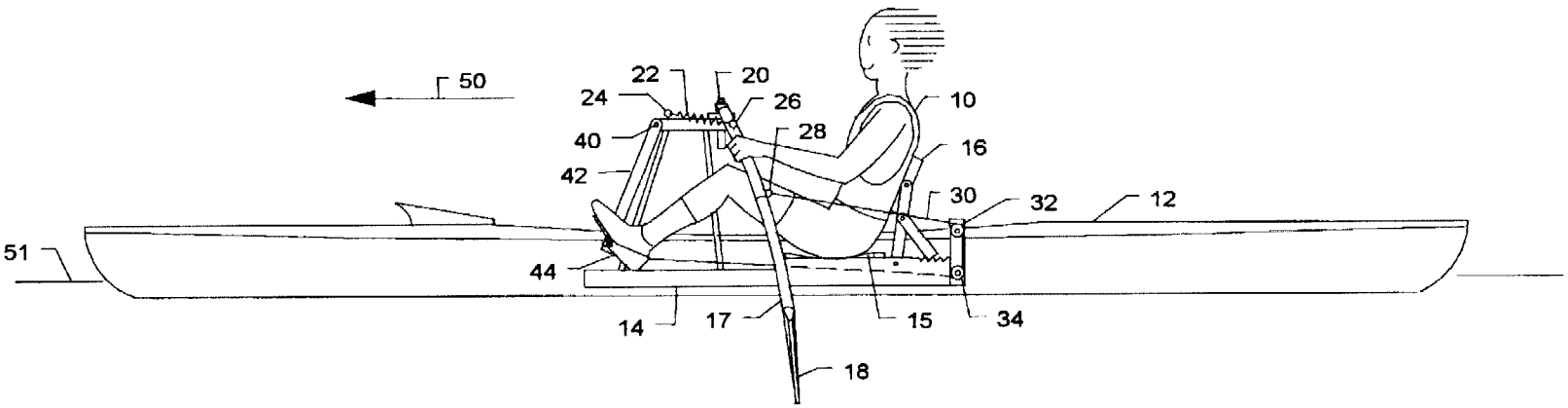
FIG. 1 is a side view of the invention as it would be installed in a boat and as it would be used by and operator using both hands and feet. The position shown is during the power delivery stroke, with the oars down in the water and the blades in the vertical position.

10 operator
12 boat
14 rowing system frame
15 seat
16 backrest
17 oar
18 oar blade
20 oarlock
22 extension spring
24 eyebolt
26 eyebolt
28 eyebolt
30 power delivery cord
32 pulley
34 pulley
40 axle
42 swing arm
44 foot pedal
50 direction of travel
51 water surface

DESCRIPTION OF INVENTION

FIG. 1 shows a version of my invention. The invention is shown installed in a boat 12. The operator 10 sits on seat 15 and leans against backrest 16. The operator 10 faces the direction of travel 50. Operator's foot rests on pedal 44 and his hand grasps oar 17. Pedal 44 is connected to swing arm 42 which pivots about axle 40. Oar 17 has blade 18 on one end and is rotatably and pivotally attached at oarlock 20 at the other end. Oarlock 20 includes a means of upwardly biasing the oar so that it clears the water when at rest. The oar 17 is shown in the power delivery position, with blade 18 vertical and below water surface 51. Extension spring 22 is stretched between eyebolt 24 and eyebolt 26. Eyebolt 24 is attached to frame 14 and eyebolt 26 is attached to oar 17. The tension of the spring pulls the oar forward so that it is in the forward position when at rest. Power delivery cord 30 is attached to pedal 44 at one end and travels through pulleys 34 and 32 and is attached to eyebolt 28 at the other end. Eyebolt 28 is attached to oar 17.

Figure 2:
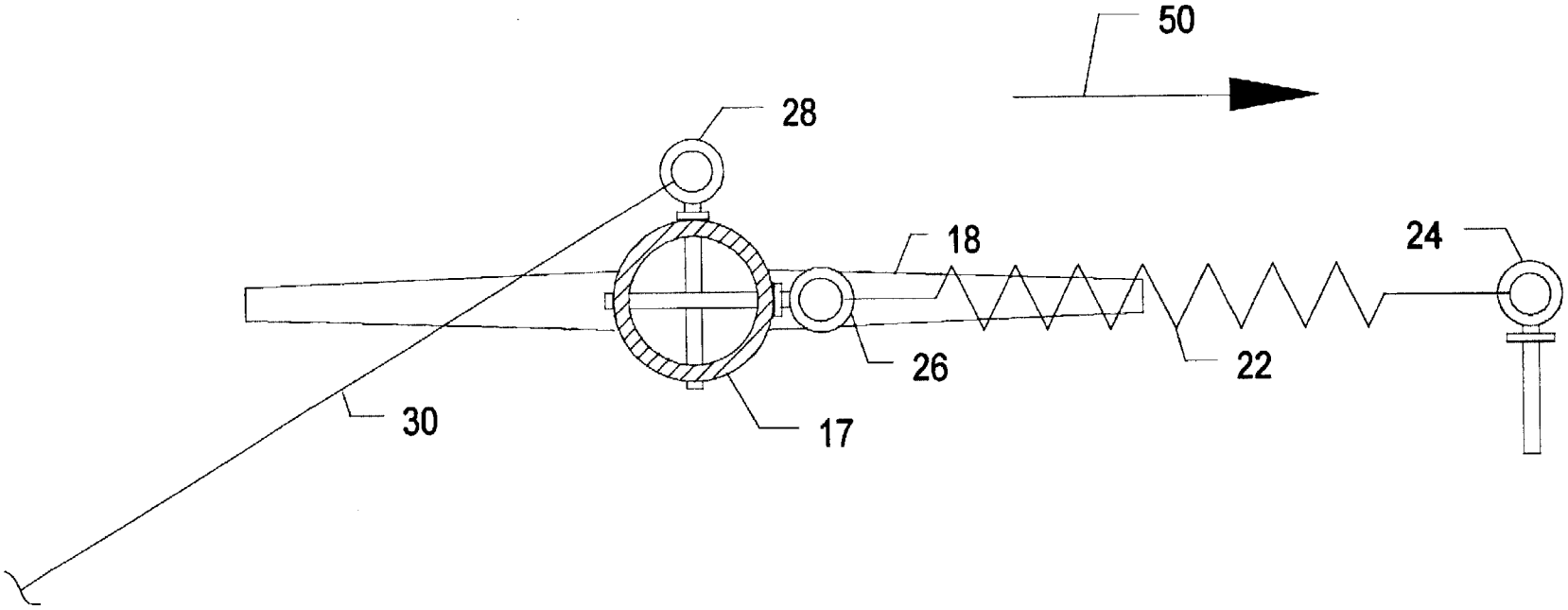
FIG. 2 is a sectional view through the oar showing how the extension spring and the power delivery cord are attached and how they rotate the oar for automatic feathering.

FIG. 2 shows a sectional view through oar 17 looking toward the blade 18. The oar is shown in the feathered position with blade 17 flat. Eyebolt 26 is the attachment means for spring 22 and is positioned on oar 17 so it is toward the front of the boat when the oar is in the feathered position. Extension spring 22 is the forward biasing means and is in tension between eyebolt 26 and eyebolt 24. Extension spring 22 also serves as the rotational biasing means. Eyebolt 28 is the attachment means for power delivery cord 30 and is positioned on oar 17 so it is above the centerline of the oar when in the feathered position. Power delivery cord 30 is attached to eyebolt 28 on one end and to a means of transmitting force from some movable part of the operator's body on the other end.

OPERATION OF INVENTION

The oar may be operated by foot only, by hand only or by both foot and hand together.

To operate by foot only, the foot is placed on pedal 44 and drawn back toward the operator. This causes the power delivery cord 30 to go slack, so that the upward bias means in oarlock 20 lifts the oar blade 18 clear of the water, and the extension spring 22 rotates the oar into the feathered position and swings it forward to the front of the boat. At the beginning of the power stroke, the operator pushes the pedal forward causing tension in the cord which pulls the cord eyebolt 28 in a downward and rearward direction. The cord tension opposes the rotational bias of the extension spring and rotates the oar back into the vertical or power delivery position. The cord tension also opposes the upward bias of the oarlock and pulls the blade down into the water. The cord tension also opposes the forward bias of the extension spring and swings the oar rearward, propelling the boat forward. In this way, by simply pushing the pedals forward and withdrawing them toward the body, the oars rotate, dip, lift and swing forward and aft at the appropriate times.

To operate by hand only, the hand is used to oppose the rotational bias, the upward bias and the forward bias, and to apply rearward motion to the oar. The forward and rotational biasing means may be disconnected or defeated if desired by disconnecting the spring 22 from eyebolt 26.

To operate with hand and foot, hand power is used primarily to augment foot power on the power stroke and the automatic functions work in the same way as with the foot only.

CONCLUSION, RAMIFICATIONS, AND SCOPE OF INVENTION

Thus the reader will see that the rowing apparatus of the invention provides a rowing system which is more adaptive to physical disabilities and is less stressful on the hands and wrists than previously known systems.

While my above description contains many specifications, these should not be construed as limitations on the scope of the invention, but rather as an exemplification of one preferred embodiment thereof. Many other variations are possible. For example:

The extension spring used to forwardly bias the oar could be replaced by a torsion spring wound about a vertical axis at the oarlock.

The rotational bias of the oar could accomplished using a torsion spring wound about the longitudinal axis of the oar.

For upper body only rowing, the foot pedals can be eliminated and the cord attached to a handle instead of a foot pedal. The handle may be gripped and pulled by a person having limited wrist movement. The lifting, feathering, dipping and power stroke rotation and the return stroke of the oar is taken care of by the above specified elements. Or the cord can be attached to any movable part of the anatomy (such as the upper arm).

For rowers having at least some hand and wrist control the extension spring can be eliminated. The oars can be rotated flat and pushed forward by a pushing motion of the hand. Rotation into the vertical position and dipping into the water is still activated by the cord pull which greatly reduces the amount of hand and wrist control required by the operator and reduces the stress on hands and wrists.

For users with paralyses on one side of the body, the ropes can be crossed over to the opposite oar so that, for example, the right foot pedal operates the left oar and the right arm operates the right oar.

For simplicity, only one oar is referred to. Oars are usually used in pairs, and any number of oars could be used on the same boat.

The invention may be a removable unit or be built integral to the boat.

Accordingly, the scope of the invention should be determined not by the embodiment illustrated, but by the appended claims and their legal equivalents.

I claim:

1. An apparatus for use in rowing of a boat having forward facing oars of the type with oarlocks at the innermost ends, said apparatus comprising:

a. an oar, b. an oarlock allowing pivotal movement of said oar upward and downward and forward and rearward, c. a means of upwardly biasing said oar such that said oar clears the water when at rest, d. a means of forwardly biasing said oar to a position approximately 30 to 60 degrees from dead ahead, whereby the oar, when at rest will be positioned ready to begin a power stroke.

2. The apparatus of claim 1, further comprising:

e. a foot pedal, f. a means of connecting said foot pedal to said oar, said connecting means being arranged such that forward movement of said foot pedal, as on the power stroke, causes downward movement dipping said oar into the water, and rearward movement of said oar propelling the boat forward, whereby the boat can be propelled by the reciprocating motion of said foot pedal only, without the use of hands.

3. The apparatus of claim 1 further comprising:

e. a handle pivotally connected to said oar, whereby power strokes can be delivered by intermittently pulling on said handle such as could be imparted by someone with limited muscular ability and said oar will be automatically returned to the front between strokes.

4. The apparatus of claim 2, further comprising:

g. a handle pivotally connected to said oar, whereby an operator can augment leg power with arm power.

5. An apparatus for use in rowing of a boat having forward facing oars of the type with oarlocks at the innermost ends, said apparatus comprising:

a. an oar, b. an oarlock allowing pivotal movement of said oar upward and downward and forward and rearward, c. a means of rotating said oar about its longitudinal axis approximately 90 degrees for feathering and power delivery positions, d. a means of rotationally biasing said oar into the blade-horizontal or feathered position, e. a means of forwardly biasing said oar in a substantially horizontal plane such that said oar will be in a forward position approximately 30 to 60 degrees from the longitudinal centerline of the boat when at rest, whereby the oar, when at rest will be positioned ready to begin a power stroke.

6. The apparatus of claim 3 further comprising:

f. a foot pedal, g. a means of connecting said foot pedal to said oar, said connecting means having its attachment point to the oar above the longitudinal centerline and being disposed so that forward movement of said foot pedal, as on the power stroke, causes rotational movement of said oar about its longitudinal axis into the blade-vertical position and rearward movement of said oar propelling the boat forward, whereby the boat can be propelled by the reciprocating motion of said foot pedal only, without the use of hands.

7. The apparatus of claim 5 further comprising:

f. a handle pivotally connected to said oar, whereby power strokes can be delivered by intermittently pulling on said handle such as could be imparted by someone with limited muscular ability and said oar will be automatically returned to the front between strokes.

8. The apparatus of claim 7 further comprising:

g. a handle pivotally connected to said oar, whereby an operator can augment leg power with arm power.

9. The apparatus of claim 2 further comprising:

g. a means of rotating said oar about its longitudinal axis approximately 90 degrees for feathering and power delivery positions, h. a means of rotationally biasing said oar about said longitudinal axis into the blade-horizontal or feathered position, whereby a a boat can be propelled by the reciprocating motion of said foot pedals only, without the use of hands, and will have the advantages of automatic feathering.

10. The apparatus of claim 9 further comprising:

i. a handle pivotally connected to said oar, whereby an operator can augment leg power with arm power.

* * * * *